US006089331A

United States Patent [19]

Christ

[11] Patent Number: 6,089,331

[45] **Date of Patent: *Jul. 18, 2000**

[54] APPARATUS AND METHOD FOR CONVERTING THE DRIVE DIRECTION AXIS OF A ROTATIONAL DRIVING SOURCE

[76] Inventor: Joseph T. Christ, 2615 Castlewood Dr., Dyer, Ind. 46311

[ * ] Notice: This patent issued on a continued prosecution application filed under 37 CFR 1.53(d), and is subject to the twenty year patent term provisions of 35 U.S.C. 154(a)(2).

[21] Appl. No.: 09/130,272

[22] Filed: Aug. 6, 1998

[51] Int. Cl.[7] ..... B25F 1/02

[52] U.S. Cl. ..... 173/216; 81/57.29; 173/29; 173/170; 173/217

[58] Field of Search ..... 173/29, 216, 217, 173/214, 171, 46, 170, 176; 81/57.13, 57.29, 57.11, 177.1, 177.85, 57.28; 74/417; 408/20, 239 A; 403/348

[56] References Cited

U.S. PATENT DOCUMENTS

| | | | |
|---|---|---|---|
| 1,325,407 | 12/1919 | Morgan | 81/57.29 |
| 1,352,354 | 9/1920 | Church | 81/57.28 |
| 1,525,357 | 2/1925 | Backscheider | 81/57.29 |
| 2,179,724 | 11/1939 | Kuehne | 81/57.13 |
| 2,273,626 | 2/1942 | Connell | 81/57.13 |
| 2,450,734 | 10/1948 | Majeski, Jr. | 74/417 |
| 2,465,309 | 3/1949 | Happe et al. | 74/417 |
| 2,604,795 | 7/1952 | Ristow | 74/417 |
| 2,620,840 | 12/1952 | Schafer | 74/417 |
| 2,654,407 | 10/1953 | Dremel | 81/57.13 |
| 2,696,859 | 12/1954 | Somma | 81/57.29 |
| 3,696,694 | 10/1972 | Boro | 81/57.29 |
| 3,724,237 | 4/1973 | Wood | 173/29 |
| 3,901,098 | 8/1975 | Jinkins | 173/216 |
| 3,905,429 | 9/1975 | Berger | 173/216 |
| 4,171,651 | 10/1979 | Dacunto | 81/57.29 |
| 4,215,601 | 8/1980 | Mann | 81/57.13 |
| 4,474,089 | 10/1984 | Scott | 81/57.29 |
| 4,620,459 | 11/1986 | Singleton | 81/57.29 |
| 4,643,052 | 2/1987 | Badiali | 81/57.28 |
| 4,821,611 | 4/1989 | Izumisawa | 81/57.29 |
| 4,913,007 | 4/1990 | Reynolds | 81/57.29 |
| 4,920,832 | 5/1990 | Van Gennep | 81/57.29 |
| 4,970,918 | 11/1990 | Brewer et al. | 81/57.29 |
| 4,976,173 | 12/1990 | Yang | 173/46 |
| 5,033,552 | 7/1991 | Hu | 173/217 |
| 5,052,496 | 10/1991 | Albert et al. | 173/29 |
| 5,063,796 | 11/1991 | Gennep | 81/57.29 |
| 5,110,145 | 5/1992 | Stewart | 408/239 A |
| 5,397,196 | 3/1995 | Boiret et al. | 403/348 |
| 5,577,425 | 11/1996 | Holmin et al. | 81/57.13 |
| 5,709,136 | 1/1998 | Frenkel | 81/57.29 |
| 5,863,159 | 1/1999 | Lasko | 81/57.29 |
| 5,915,482 | 6/1999 | Carruthers | 403/348 |

*Primary Examiner*—Peter Vo
*Assistant Examiner*—Jim Calve
*Attorney, Agent, or Firm*—Marshall, O'Toole, Gerstein, Murray & Borun

[57] ABSTRACT

A device for rotating tools on an axis which is not parallel to the rotational axis of a rotational driving source. Bevel gears and other mechanical means redirect forces from a rotational driving source, such as a portable rechargeable screwdriver, into forces capable of rotating tools to perform tasks on an axis not parallel to the rotational axis of the driving source. A rigid housing encloses most of the mechanical means for redirecting forces. A preferred embodiment comprises an adapter kit including a plurality of connectors for connecting the housing of the device to a plurality of differently sized powered driving sources. A method is also described in which tools may be rotated on an axis not parallel to the rotational axis of the rotational drive source.

18 Claims, 10 Drawing Sheets

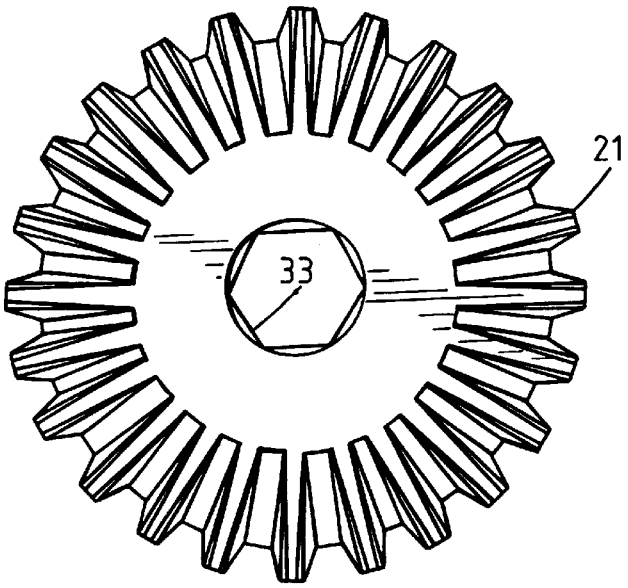
FIG. 3
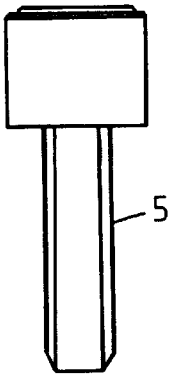
FIG. 4A
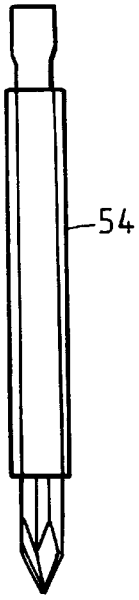
FIG. 4B
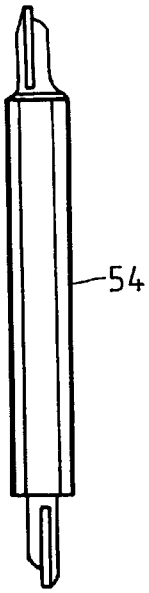
FIG. 4C
FIG. 4D
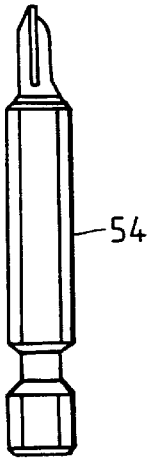
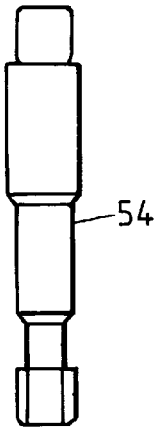
FIG. 4E

APPARATUS AND METHOD FOR CONVERTING THE DRIVE DIRECTION AXIS OF A ROTATIONAL DRIVING SOURCE

BACKGROUND OF THE INVENTION

1. Field of the Invention

The present invention is generally directed to an apparatus for rotating tools. More particularly, the present invention is directed to an apparatus which rotates tools along an axis not parallel to the rotational axis of a removably attached driving source.

2. Background of the Prior Art

A variety of devices have been designed for manipulating mechanical fasteners perpendicular to the rotational drive axis. Some of these devices are operated manually. A manual driver for socket wrenches and similar tools is disclosed in U.S. Pat. No. 4,474,089 to Scott. U.S. Pat. No. 4,620,459 to Singleton discloses a self-contained manual device for removing nuts and bolts. These devices lack the speed and the other advantages of a powered driving source.

Of the motor driven devices in the prior art, some of the devices include the motor as part of the invention. For example, U.S. Pat. No. 2,654,407 to Dremel discloses a motor-driven screw driver with a motor housed in a casing. U.S. Pat. No. 3,905,429 to Berger is a self-contained battery powered hand tool. In such inventions the manipulating shafts and gears have the disadvantage of being associated with one particular motor. Ideally, a device for converting the rotational axis of a drive source would be removably attachable to a variety of drive sources in order to obtain advantages (e.g., size, cost, availability, speed or power) peculiar to each of the various drive sources.

Some devices require two hands to operate in order for the conversion device to be steadily held while being driven by a powered drive source. One hand holds the powered drive source while the other hand holds the conversion device firmly in place upon the conversion device. By requiring two hands for operation, such devices are less maneuverable, especially in tight spaces, than a device requiring only one hand for operation. It is also less convenient for the operator because both hands will be occupied with the task of operating the device.

SUMMARY OF THE INVENTION

The aforementioned problems with the prior art devices are overcome by drive direction conversion devices constructed in accordance with the present invention. Compatibility with powered drive sources and compactness make the present invention effective in tight working areas, particularly working areas which are tight in the direction parallel to the rotational axis of the tool to be rotated. Various powered driving sources, such as different brands of rechargeable screwdrivers, can be connected to some embodiments of the present invention. Once connected to a powered driving source, the present invention may be operable using only one hand.

In one embodiment of the present invention, a converter for a rotational driving source comprises a housing, a shaft disposed in the housing and having structure for holding a tool or a tool chuck, and first and second bevel gears oriented obliquely with respect to each other and having teeth engaged. The first gear is mounted on the shaft in the housing, the second bevel gear has structure for coupling to a rotating drive member of a rotational driving source. This embodiment further comprises connecting means for removably connecting the housing to the main body of a rotational driving source.

During operation, a rotational driving member of a rotational driving source, such as a drive bit of a rechargeable screwdriver, is removably engaged to the second bevel gear. The second bevel gear rotates the first bevel gear which rotates the shaft. A rotary tool coupled to the end of the shaft rotates on an axis different from the rotational axis of the rotational driving member.

The connecting means may be a fitting having a first end which is adapted to engage the housing and a second end adapted to engage the rotational driving source. The fitting defines a channel from the first end to the second end in which a rotating member of the rotational drive source can rotate. The connector may comprise a slit extending from the second end toward the first end. Additionally or alternatively, the connector may threadably engage the housing of the apparatus or housing of a rotational driving source.

The fitting may have a plurality of slats for frictionally engaging the rotational driving source. The apparatus may include a collar for retaining the slats of the connector on the rotational driving source.

The connecting means may be an adaptor kit for removably attaching the housing to a plurality of differently sized rotational drive sources. The adaptor kit comprises a plurality of fittings, each of the fittings having a first end adapted to be removably attached to the housing. The second end of each fitting has different dimensions than the second ends of the other fittings. Each of the second ends of the plurality of fittings is adapted to be removably attached to the outer body of a different rotational driving source.

Another aspect of the present invention is a method for converting the direction of a rotational drive source from one direction to another. The method of the present invention comprises the steps of providing an apparatus such as the apparatus described above, connecting the first end of the connector to the apparatus housing, removably attaching the second end of the connector to a rotational driving source, and coupling the second bevel gear with a drive bit or some other rotating member from the rotational drive source.

Alternatively, in embodiments in which the second bevel gear is integral with a drive shaft, the method may include the step of engaging the integral drive shaft with a rotating member of the rotational drive source instead of the step of coupling the second bevel gear with the drive bit of the rotational driving source.

BRIEF DESCRIPTION OF THE DRAWINGS

The above and other objects, advantages and novel features of the present invention will become apparent from the following detailed description of a preferred embodiment of the invention illustrated in the accompanying drawings wherein:

FIG. 3 is a plan view of a bevel gear suitable for use in the present invention;

FIGS. 4A–4E are side elevational views of various tool bits suitable for use with the present invention;

DETAILED DESCRIPTION OF THE PREFERRED EMBODIMENT

Figure 1:
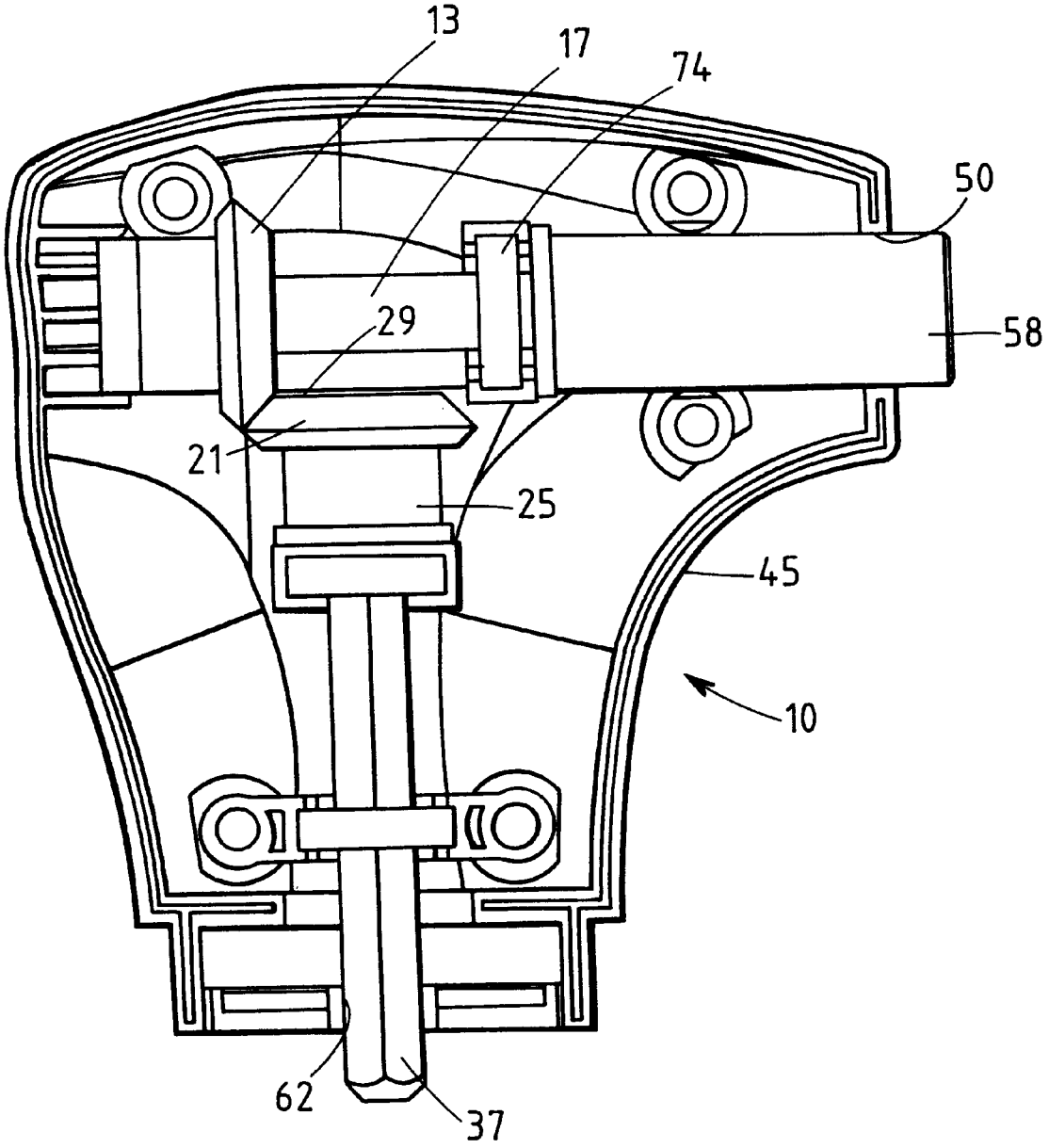
FIG. 1 is a side elevational view of a drive direction conversion apparatus, constructed in accordance with one embodiment of the present invention, shown with a portion of the housing removed to reveal detail.
Figure 2:
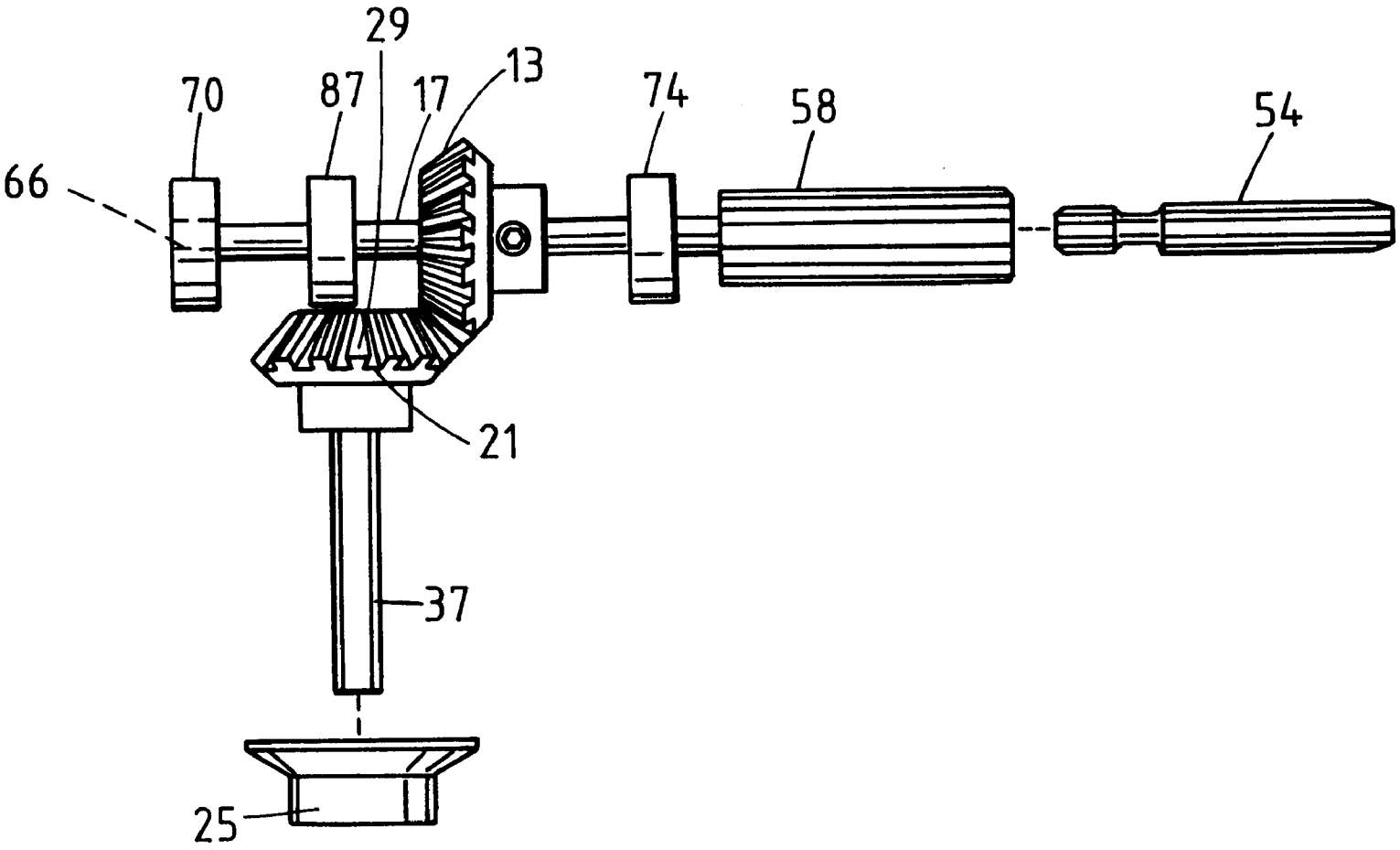
FIG. 2 is a partially exploded side elevational view of a drive train similar to the drive train of the embodiment of FIG. 1.

A drive direction conversion apparatus according to the present invention is shown in FIG. 1, and is designated generally at 10. A drive train of apparatus 10 similar to the drive train of FIG. 1 is shown in FIG. 2. A first bevel gear 13 (shown without teeth in FIG. 1) is coaxially mounted on a shaft 17. The shaft 17 and bevel gear 13 can be integral. First bevel gear 13 is transverse to and meshingly engaged with a second bevel gear 21 (shown without teeth in FIG. 1). Bevel gear 21 may be pivotally mounted in a pivot bushing or beveled seat 25.

Bevel gear 21 may be composed of nylon and beveled seat 25 may be composed of bronze or brass. An end 29 of bevel gear 21 is the end of bevel gear 21 having teeth. Bevel gear 21 has a center hole 33 (FIG. 3) which accommodates a drive bit 37 associated with a rotational driving source 41 (FIG. 6), the center hole 33 thus coupling the rotational driving source 41 to bevel gear 21. Other coupling devices are well known in the art. A common drive bit 37 is a hexagonal bit, and the hole 33 may have a hexagonal shape to accommodate such a drive bit.

Shaft 17 may be ¼ inch in diameter and be about 3 and ¼ inches in length. Bevel gear 13 may have a ¾ inch diameter and have a ¼ inch hole to receive shaft 17. Bevel gear 21 may have a ¾ inch diameter and have a ¼ inch hexagonal hole 33 to accommodate hexagonal drive bits.

A housing 45 encloses bevel gear 13, bevel gear 21, and at least a portion of shaft 17. Shaft 17 extends from bevel gear 13 toward an opening 50 (FIG. 1) defined by housing 45. In some embodiments shaft 17 may extend through opening 50.

Fastener driving devices or other tools 54, such as drill bits, can be attached to shaft 17 adjacent opening 50. Examples of such fastener driving devices and tools 54 are shown in FIGS. 4A–4E. The tool of FIG. 4A has a hexagonal socket for receiving hexagonal members. Structure for coupling shaft 17 to devices for manipulating mechanical fasteners or to other tools can be attached to shaft 17. Such a coupling structure is shown as a chuck 58. Chuck 58 may have a ¼ inch inner diameter for coupling ¼ inch tools 54.

In an alternative embodiment (not shown), bevel gear 21 is integral with a drive shaft. In such an embodiment, the drive shaft couples with the rotational driving source 41. The drive shaft of this embodiment differs from drive bit 37 in that the drive shaft is integral with bevel gear 21 whereas drive bit 37 can be removably coupled to bevel gear 21.

In embodiments comprising removable drive bit 37, an opening 62 (FIG. 1) defined by the housing 45 allows drive bit 37 to be removably attached to bevel gear 21. Drive bit 37 passes through opening 62.

Drive bit 37 is adapted to engage bevel gear 21 in such fashion as to drive bevel gear 21 which, in turn, drives bevel gear 13 and shaft 17. Drive bit 37 and shaft 17 are not parallel. Hence, when shaft 17 is driven by drive bit 37, the drive axis is converted from the axis of drive bit 37 to the axis of shaft 17. Although shown in the drawings as perpendicular to one another, drive bit 37 and shaft 17 can be at other angles relative to one another.

An end 66 of shaft 17 distal from opening 50, may be rotatingly engaged in a bushing 70 (FIG. 2) which is supported radially by housing 45. Bushing 70 may be composed of bronze. Many other support structures for shafts are known to those skilled in the art.

For stability, additional bushings may be mounted coaxially around shaft 17. For example, a bushing 74 may be disposed between bevel gear 13 and chuck 58. Bushing 74 may be bronze. Disposed on the opposite side of bevel gear 13, between bevel 13 and bushing 70, is a bushing 87 (FIG. 2) which keeps bevel gear 21 at an effective distance from shaft 17 during operation.

Figure 5:
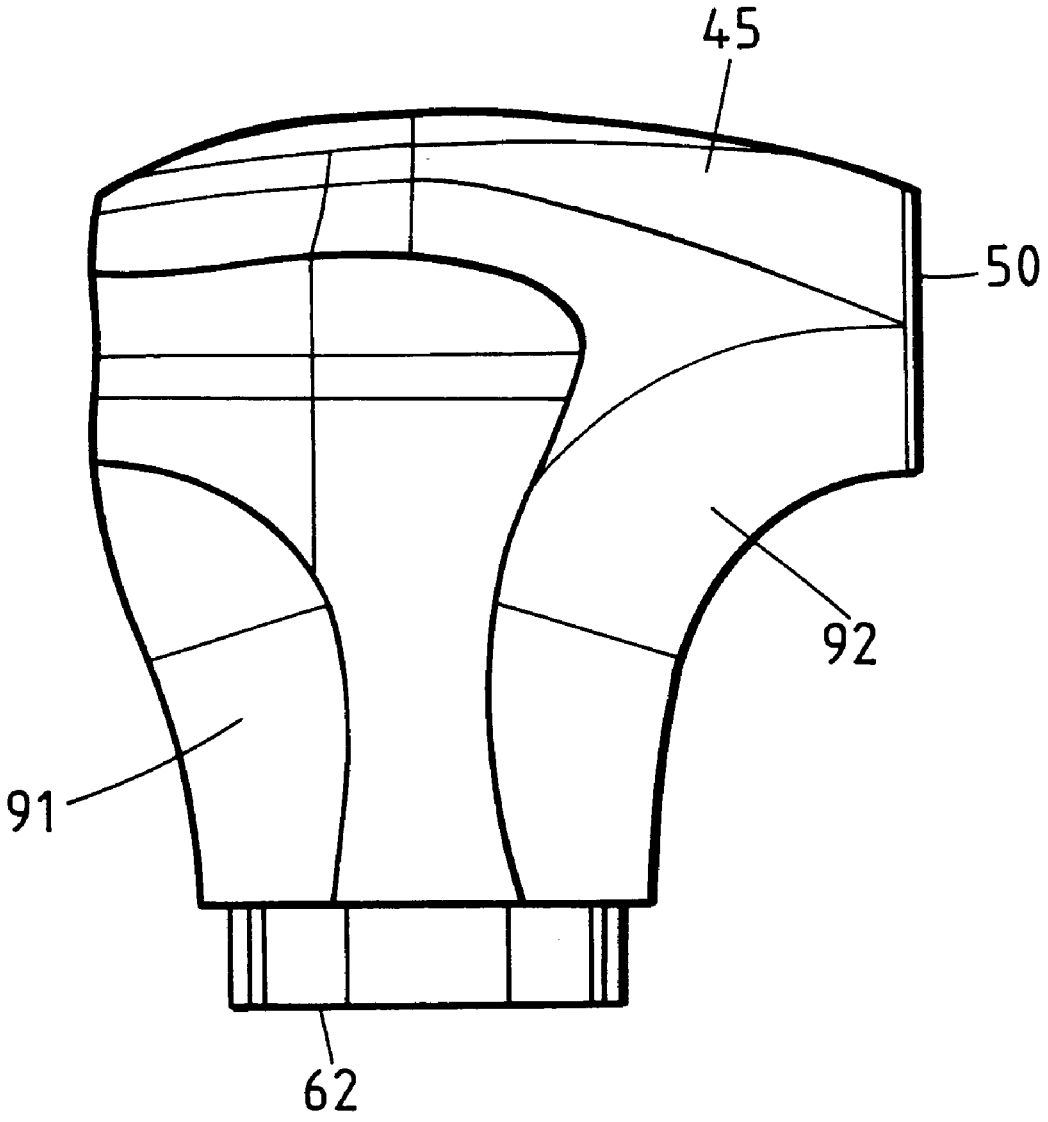
FIG. 5 is a side elevational view of a housing in accordance with the present invention.

As seen in FIG. 5, housing 45 may have portions 91 and 92 that are contoured for sturdy gripping by the hand of an operator. Contour portions 91 and 92 each comprise a valley defining contours for receiving the palm and fingers, respectively, of an operator.

Figure 6:
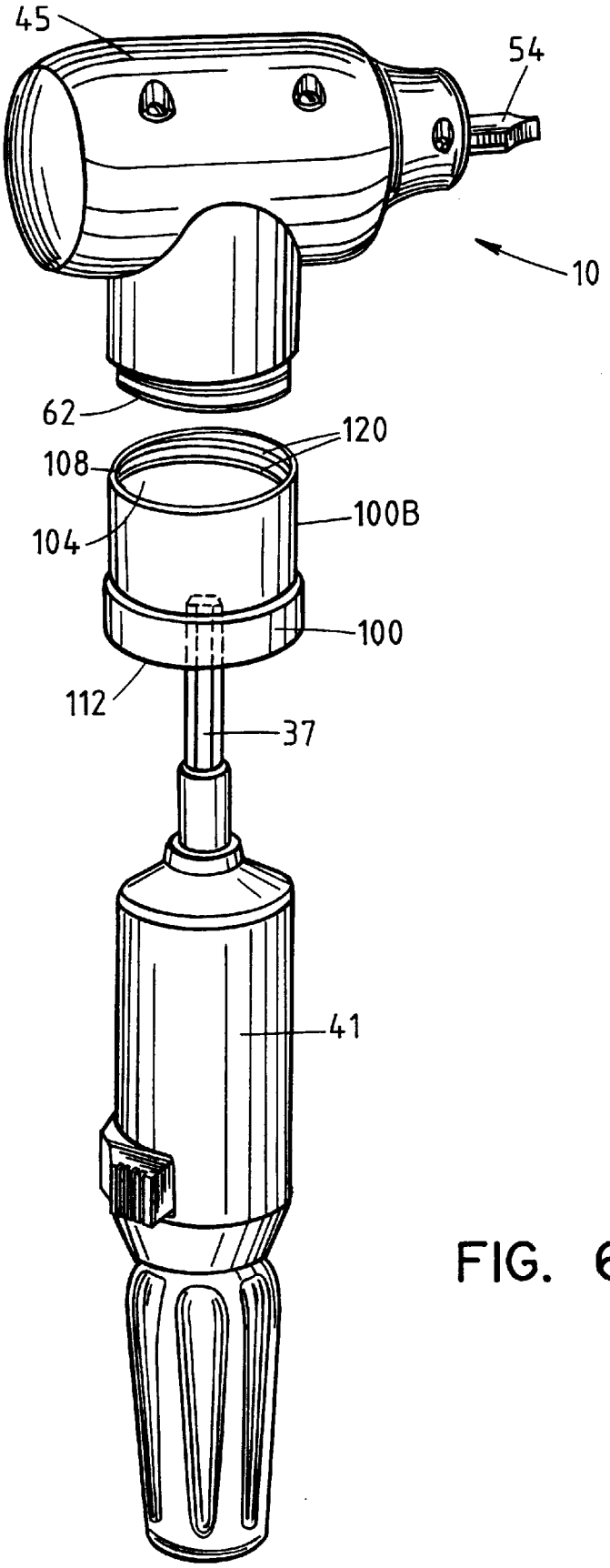
FIG. 6 is an exploded view of an embodiment of the present invention including a connector, shown with a driving source.

As seen in FIG. 6, a connector 100 removably connects housing 45 to the housing of a rotational driving source 41. Connector 100 connects to housing 45 in such fashion that the rotational drive member 37 of the rotational driving source 41 can pass through second opening 62 and connect to bevel gear 21. Connector 100 defines a channel 104 at least wide enough for the rotational drive member 37 to pass through.

Connector 100 may be generally cylindrical and has a first end 108 and a second end 112. As described in more detail below, first end 108 may engage housing 45 at opening 62 in any suitable fashion such as threadable engagement, slip-on and twist-lock engagement, or snap-on engagement. Second end 112 of connector 100 may engage the housing of a rotational driving source 41 in any suitable fashion including threadable engagement, slip-on and twist-lock engagement, or snap-on engagement.

FIGS. 7A–7F show alternative embodiments 100A–100F of connector 100. Connector 100A (FIG. 7A) may slidably engage housing 45. Additionally connector 100A may comprise slits 114 for engaging pins (not shown) or ridges (not shown) or other contours of housing 45 to lock connector 100A and prevent rotation of connector 100A with respect to housing 45 during operation. Connector 100A also has a channel 117 extending to second end 112 for engaging the housing of a rotational driving source 41.

Figure 7B:
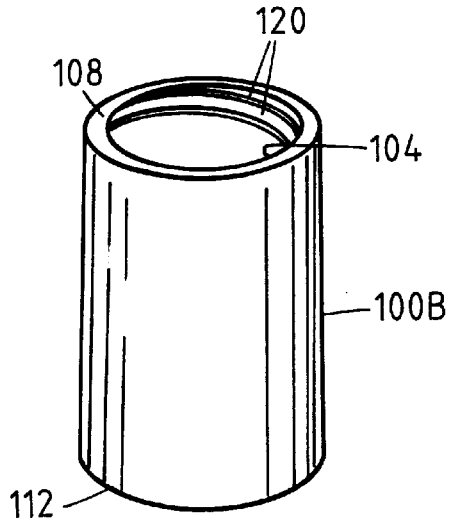
FIGS. 7A–7F are perspectives of various connectors in accordance with the present invention.
Figure 7A:
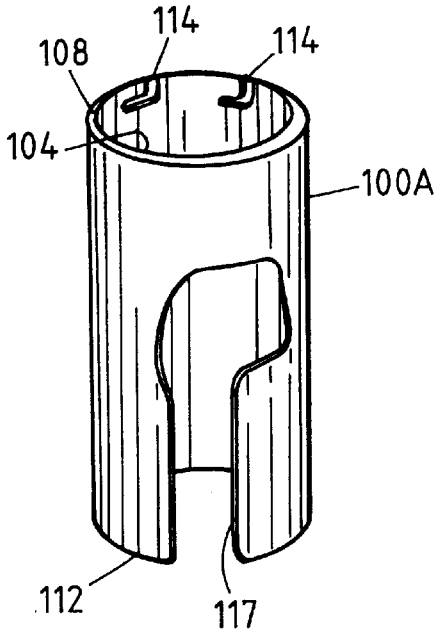
Figure 7C:
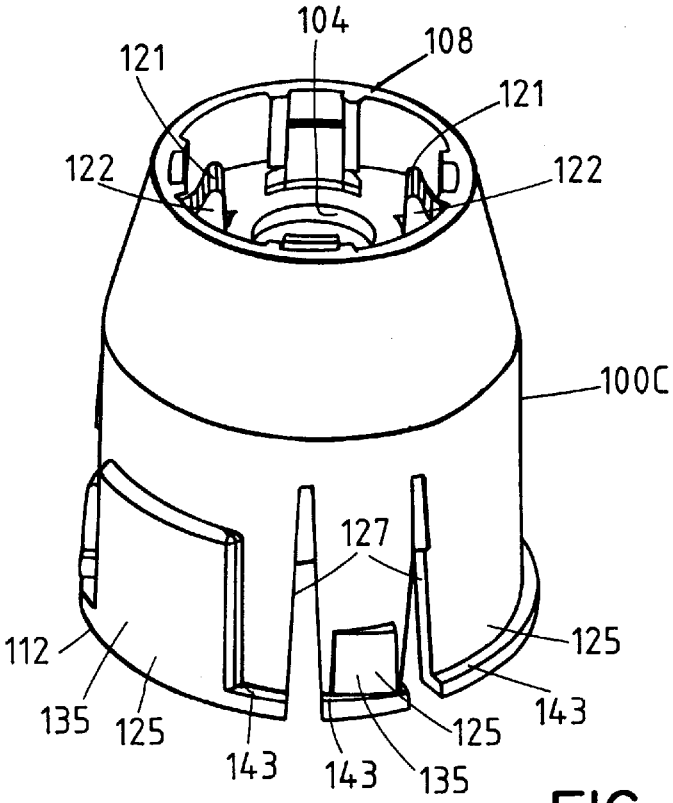
Figure 7D:
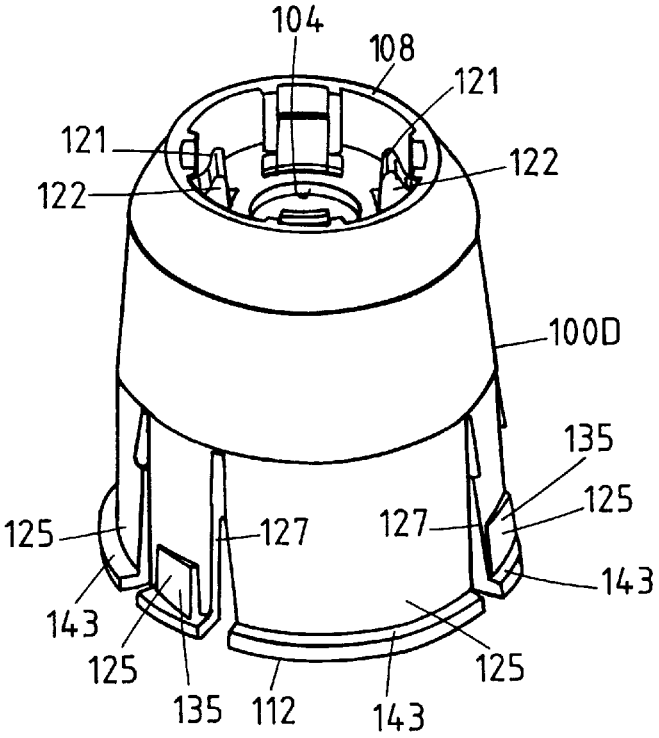
Figure 7E:
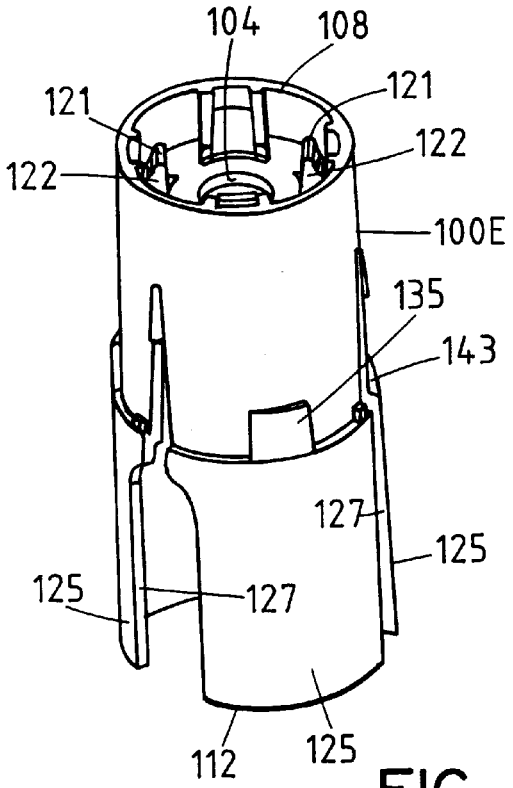
Figure 7F:
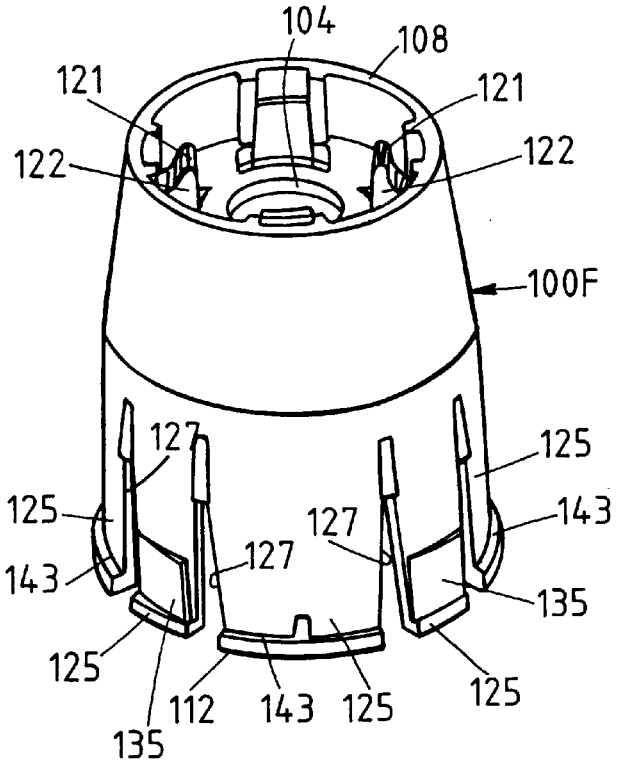

FIG. 7B shows connector 100B in which first end 108 has threads 120 for threadably engaging an embodiment of apparatus 10 having a housing 45 with threads (FIG. 6).

FIGS. 7C–7F show connectors 100C–100F having first ends 108 which may snap onto housing 45. Connectors 100C–100F each comprise a pair of male members 121 which are flexible and which each have a wedge-like portion 122. The wedge-like portions 122 engage respective indentations (not shown) in the housing 45, producing a snap-fit. The snap engagement is produced by sliding first end 108 into housing 45 until the wedge-like portions 122 move into the respective indentations. An operator may remove connectors 100C–100F from housing 45 by pressing button-like members (not shown) on the outside of connectors 100C–100F, the button-like members being coupled to the male members 121. Snap-fit engagement of connectors 100C–100F to housing 45 is convenient for an operator because it is fast to connect, sturdy, and easily removable.

Connectors 100C–100F may have flexible slats 125 (FIGS. 7C–7F). The slats 125 permit connectors 100C–100F to frictionally engage the housing of a rotational driving source 41. The slats 125 define slits 127 therebetween. The length and width of the slats 125 may be varied to alter the strength of the frictional engagement and to permit the connectors 100C–100F to fit housings of different dimensions (i.e., housings of different models of rotational driving sources).

Figure 8:
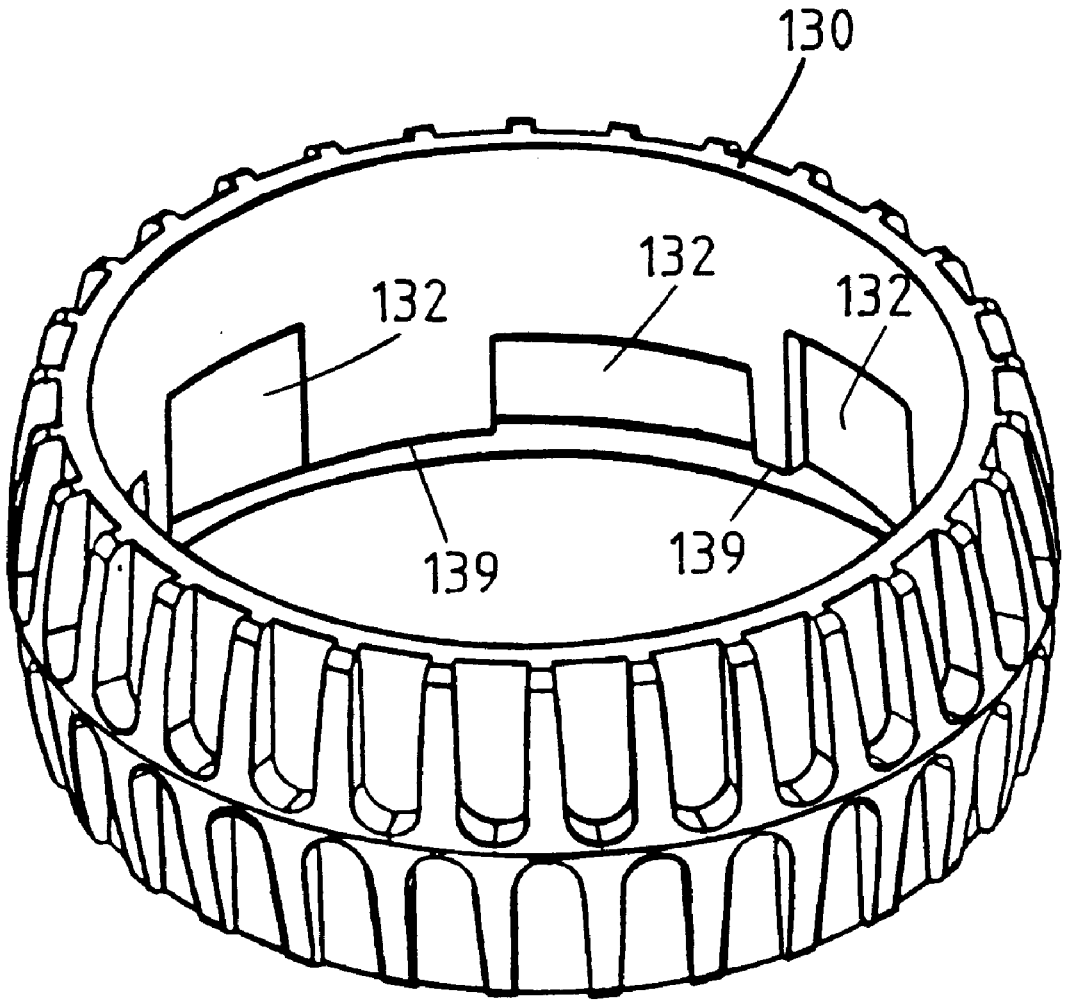
FIG. 8 is a perspective of a collar in accordance with an aspect of the present invention.
Figure 9A:
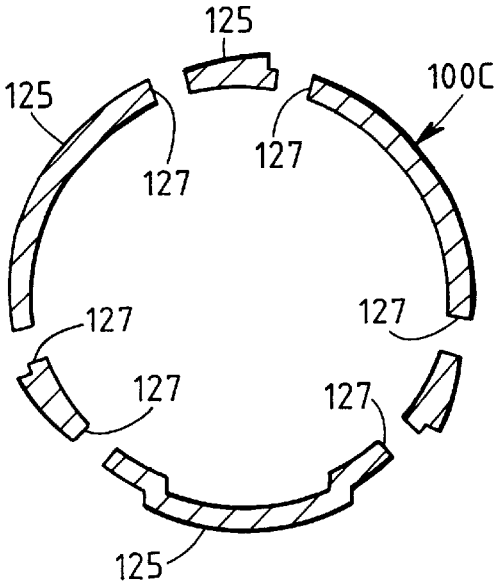
FIGS. 9A–9D are cross-sectional views of the connectors of FIGS. 7C–7F, respectively.
Figure 9B:
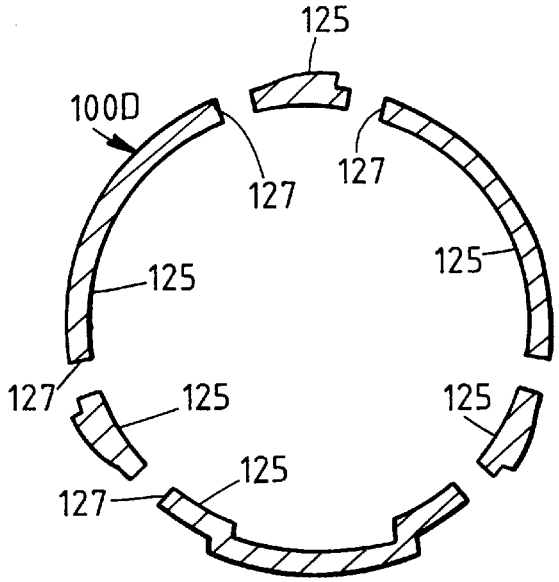
Figure 9C:
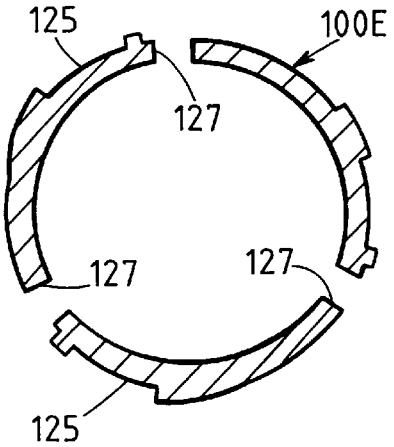
Figure 9D:
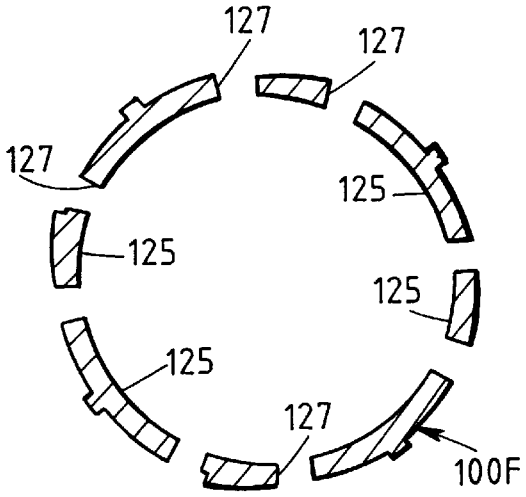

A collar 130 (FIG. 8) may be slidably disposed around connectors 100C–100F to constrain slats 125 from spreading out radially during operation. The collar 130 thus retains the frictional engagement between the slats 125 and the housing of a rotational driving source 41. To remove the connectors 100C–100F from the housing of a rotational driving source 41, an operator simply slides the collar 130 off of the slats 125 and lifts the slats 125 away from the rotational driving source 41 housing, thereby releasing the connectors 100C–100F.

The inside surface of the slats 125 may be knurled, the small ridges increasing frictional engagement of the slats 125 to the outer surface of the rotational driving source 41 housing. Also, collar 130 may comprise interior depressions 132 to facilitate movement of collar 130 over slats 125 and to engage protrusions 135 located on slats 125. Also, collar 130 may comprise an interior ledge 139 for abutting a skirt 143 located on the slats 125 to prevent the collar 130 from being slipped too far down the slats 125. Thus, the interior ledge 139 and the skirt 143 help maintain the collar 130 in an effective position upon the connectors 100C–100F.

FIGS. 9A–9D illustrate cross-sectional views of the connectors 100C–100F, respectively. The cross-sections are taken in a plane (a) perpendicular to a longitudinal axis of the connectors 100C–100F and (b) extending through a location adjacent skirt 143 on connectors 100C–100F. The number of slats 125 in a particular connector and the relative sizes and spacings of those slats can be seen in FIGS. 9A–9D.

The firmness of the engagement between connectors 100C–100F and housing 45 and between connectors 100C–100F and the housing of rotational driving source 41 allows the conversion of the rotational driving direction without a user having to hold apparatus 10 still or connector 100 still relative to rotational driving source 41. Thus, when in operation, one hand may fully operate the apparatus 10 by simply holding steady the powered rotational driving source 41.

A plurality of connectors, connectors 100C–100F, may be provided. Each connector 100C–100F can be removably connected to housing 45 in the various fashions described above for connector 100 generally. Further, each of the plurality of connectors 100C–100F can be removably engaged to the housing of a particular rotational driving source 41, each connector 100C–100F being a different size than the other connectors 100C–100F. Thus, connectors 100C–100F enable apparatus 10 to be attached to a variety of different commercial brands of rotational drive sources 41, many of which have housing dimensions different from each other.

Because of the flexibility of the slats 125, some of the connectors 100C–100F can fit onto more than one commercial brand of rotating driving source 41. Tables 1–4 below indicate commercial brands that can be accommodated by connectors 100C–100F. Table 1corresponds to connector 100C, Table 2 corresponds to connector 100D, Table 3 corresponds to connector 100E, and Table 4 corresponds to connector 100F.

TABLE 1

| 100C | |
|---|---|
| BRAND | MODEL |
| Black and Decker | 901.8-02 2.4V |

TABLE 2

| 100D | |
|---|---|
| BRAND | MODEL |
| Sears/Craftsman Heavy-Duty | 911182 3.6V |
| Sears/Craftsman In-Line Power | 911169 3.6V |

TABLE 3

| 100E | |
|---|---|
| BRAND | MODEL |
| Sears/Craftsman | 2210 2.4V |
| Singer Journeyman | MM-8520 2.4V |
| Driving Force | MM-8521 2.4V |

TABLE 4

| 100F | |
|---|---|
| BRAND | MODEL |
| Skil Super Twist | 2210 |
| Mister Mechanic | MM-8520 |
| True Value | MM-8521 2.4V |
| True Value | MM-8523 3.6V |

In operation, drive direction conversion apparatus 10 is removably attached to the rotational driving source 41, such as a rechargeable portable screwdriver. As discussed above and noted in Tables 1–4, many commercial brands of driving sources 41 can be accommodated using one of the connectors 100C–100F to adapt apparatus 10 to the dimensions of the housings of the commercial driving sources 41.

Apparatus 10 may alternatively be attached directly to a powered rotational drive source 41 without the use of a connector 100. This use of apparatus 10 requires only that the powered rotational drive source 41 have a housing of the appropriate shape and dimensions to attach to housing 45 at opening 62 in the same fashion that first end 108 of connector 100 would connect to housing 45 at opening 62. Thus, in such an embodiment, the connecting structure is integral with housing 45.

Another aspect of the invention is a method for converting the direction of a rotational drive source 41 from one direction to another. The method of the present invention comprises the steps of providing an apparatus such as apparatus 10 described above, connecting end 108 of connector 100 to housing 45, removably attaching end 112 of connector 100 to rotational driving source 41, and coupling bevel gear 21 with drive bit 37 or some other rotating member of a drive source 41. Alternatively, in embodiments in which bevel gear 21 is integral with a drive shaft, the method may include the step of engaging the integral drive shaft with a rotating member of the drive source 41 instead of the step of coupling bevel gear 21 with drive bit 37.

Obviously, many modifications and variations of the present invention are possible in light of the above teachings. Thus, it is to be understood that, within the scope of the appended claims, the invention may be practiced other than as specifically described above.

What is claimed is:

1. A connector for coupling a housing of a rotational drive source to a housing of a rotational drive convertor, the connector comprising:

a connector body defining a channel therethrough and having a first end at a first opening of the channel and a second end spaced from the first end at a second opening of the channel, wherein the first end includes an engagement structure surrounding the first opening for engagement with the housing of the rotational drive convertor and wherein the second end includes a plurality of flexible slat portions; and a collar disposed around the connector body that slides over outer surfaces of the plurality of flexible slat portions to drive inner surfaces of the plurality of flexible slat portions into frictional engagement with the housing of the rotational drive source.

2. The connector of claim 1, further comprising a skirt portion adjacent to the second end of the connector body that limits travel of the collar along the connector body.

3. The connector of claim 2, wherein the collar further includes an interior ledge for abutment with the skirt.

4. The connector of claim 1, wherein the inner surfaces of the plurality of flexible slat portions include textured portions.

5. The connector of claim 4, wherein the textured portions include knurled portions.

6. The connector of claim 1, wherein the connector body is cylindrically shaped.

7. The connector of claim 1, wherein the plurality of flexible slat portions further includes protrusions that engage an inner surface of the collar.

8. The connector of claim 7, wherein the inner surface of the collar includes depressions that engage with the protrusions to locate the collar on the connector body.

9. The connector of claim 1, wherein the collar includes a textured outer surface.

10. A connector for coupling a housing of a rotational drive source to a housing of a rotational drive convertor, the connector comprising:

a connector body defining a channel therethrough and having a first end at a first opening of the channel and a second end spaced from the first end at a second opening of the channel, wherein the first end includes flexible wedge shaped portions surrounding the first opening for snap-fit engagement with the housing of the rotational drive convertor and wherein the second end includes a plurality of flexible slat portions; and a collar disposed around the connector body that slides over outer surfaces of the plurality of flexible slat portions to drive inside surfaces of the plurality of flexible slat portions into frictional engagement with the housing of the rotational drive source.

11. The connector of claim 10, wherein the connector body is cylindrically shaped.

12. A connector for coupling a housing of a rotational drive source to a housing of a rotational drive convertor, the connector comprising:

a connector body defining a channel therethrough and having a first end at a first opening of the channel and a second end spaced from the first end at a second opening of the channel, wherein the first end includes an engagement means that engages with the housing of the rotational drive convertor and wherein the second end includes a plurality of flexible slat portions having outer surfaces for receiving a slidable collar and inner surfaces for frictionally engaging with the housing of the rotational drive source; and a collar disposed around the connector body that slides over the outer surfaces of the plurality of flexible slat portions.

13. The connector of claim 12, further comprising a skirt portion adjacent to the second end of the connector body that limits travel of the collar along the connector body.

14. The connector of claim 13, wherein the collar further includes an interior ledge for abutment with the skirt.

15. The connector of claim 12, wherein the inner surfaces of the plurality of flexible slat portions include textured portions.

16. The connector of claim 12, wherein the plurality of flexible slat portions further includes protrusions for engagement with an inside surface of the collar.

17. The connector of claim 16, wherein the inside surface of the collar includes depressions that engage the protrusions to locate the collar on the connector body.

18. The connector of claim 12, wherein the connector body is cylindrically shaped.

* * * * *